US010115382B2

(12) United States Patent
Nishimura

(10) Patent No.: US 10,115,382 B2
(45) Date of Patent: Oct. 30, 2018

(54) KEYBOARD DEVICE AND KEYBOARD INSTRUMENT

(71) Applicant: CASIO COMPUTER CO., LTD., Tokyo (JP)

(72) Inventor: Yuichi Nishimura, Saitama (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/850,001

(22) Filed: Dec. 21, 2017

(65) Prior Publication Data

US 2018/0197514 A1 Jul. 12, 2018

(30) Foreign Application Priority Data

Jan. 10, 2017 (JP) ..... 2017-002048

(51) Int. Cl.
*G10H 1/32* (2006.01)
*G10H 1/34* (2006.01)
*G10C 3/18* (2006.01)

(52) U.S. Cl.
CPC ..... *G10H 1/346* (2013.01); *G10C 3/18* (2013.01)

(58) Field of Classification Search
CPC ..... G10H 1/346; G10C 3/18
USPC ..... 84/719
See application file for complete search history.

(56) References Cited

U.S. PATENT DOCUMENTS

2008/0307944 A1* 12/2008 Watanabe ..... G10C 3/12 84/433

FOREIGN PATENT DOCUMENTS

| | | | |
|---|---|---|---|
| JP | 2002-182650 | A | 6/2002 |
| JP | 2001-236056 | A | 8/2008 |
| JP | 2013-210658 | A | 10/2013 |
| JP | 2015-34853 | A | 2/2015 |

* cited by examiner

*Primary Examiner* — Jeffrey Donels
(74) *Attorney, Agent, or Firm* — Fitch, Even, Tabin & Flannery LLP

(57) ABSTRACT

A keyboard device includes a plurality of hammer members provided corresponding to a plurality of keys, whereby each hammer member applies an action load to a depressed key by rotating in conjunction with the key, and a key load applying member which applies a key load to the key by the hammer member coming in contact therewith when the hammer member is rotated, in which the key load applying member is singly provided corresponding to the plurality of keys, and a first portion of the key load applying member corresponding to a first key and a second portion of the key load applying member corresponding to a second key are different in at least one of thickness, level of elasticity, and level of viscosity.

12 Claims, 8 Drawing Sheets

KEYBOARD DEVICE AND KEYBOARD INSTRUMENT

CROSS-REFERENCE TO RELATED APPLICATION

This application is based upon and claims the benefit of priority from the prior Japanese Patent Application No. 2017-002048, filed Jan. 10, 2017, the entire contents of which are incorporated herein by reference.

BACKGROUND OF THE INVENTION

1. Field of the Invention

The present invention relates to a keyboard device for use in a keyboard instrument such as an electronic piano and a keyboard instrument including the keyboard device.

2. Description of the Related Art

For example, a keyboard device is known which includes a plurality of keys whose lengths in the front-rear direction differ for each sound pitch and in which, when keys are depressed, hammer members are rotated by the depressed keys and the upper-limit positions of the rotated hammer members are restricted by upper-limit stoppers, as described in Japanese Patent Application Laid-Open (Kokai) Publication No. 2015-034853.

Since this type of keyboard device is structured to have the keys whose lengths in the front-rear direction differ for each sound pitch, when a plurality of keys is depressed, the rotation amounts of these keys differ for each sound pitch, and therefore the rotation amounts of their hammer members differ for each sound pitch. Accordingly, the contact forces of the hammer members coming in contact with upper-limit stoppers differ for each sound pitch.

SUMMARY OF THE INVENTION

In accordance with one aspect of the present invention, there is provided a keyboard device comprising: a plurality of hammer members provided corresponding to a plurality of keys, whereby each hammer member applies an action load to a depressed key by rotating in conjunction with the key; and a key load applying member which applies a key load to the key by the hammer member coming in contact therewith when the hammer member is rotated, wherein the key load applying member is singly provided corresponding to the plurality of keys, and a first portion of the key load applying member corresponding to a first key and a second portion of the key load applying member corresponding to a second key are different in at least one of thickness, level of elasticity, and level of viscosity.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment where the present invention has been applied in a keyboard instrument will hereinafter be described with reference to FIG. 1 to FIG. 4.

Figure 1:
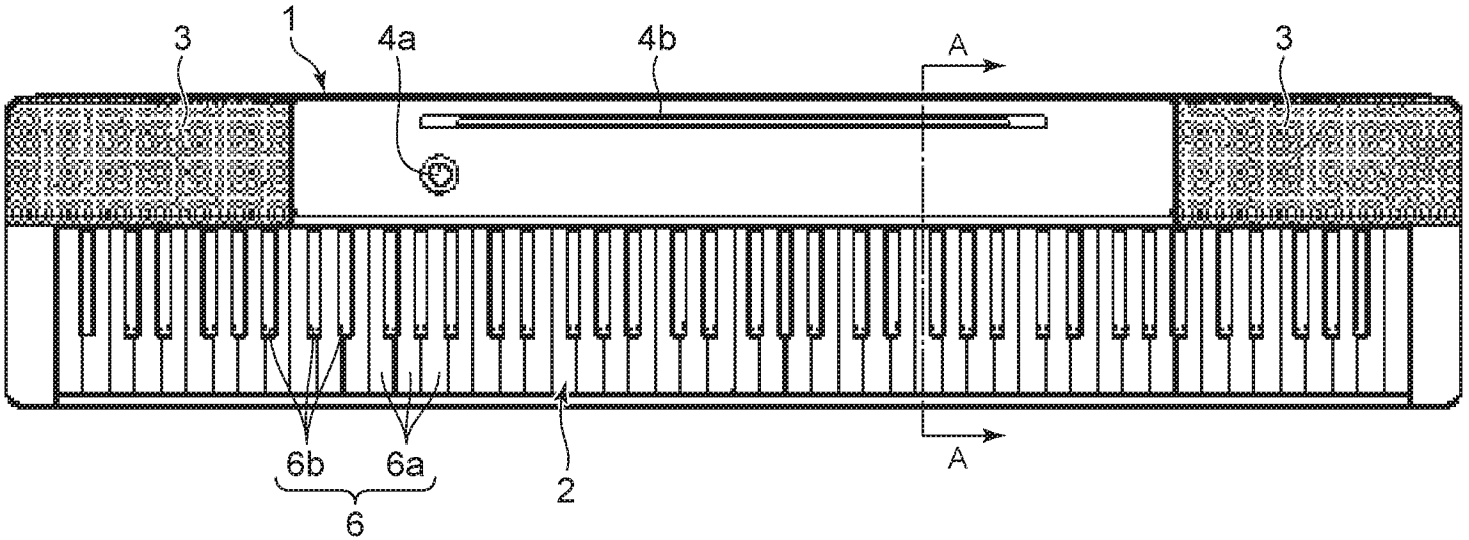
FIG. 1 is a planar view of an embodiment where the present invention has been applied in a keyboard instrument.

This keyboard instrument includes an instrument case 1, as shown in FIG. 1. This instrument case 1 has a keyboard device 2 arranged to be exposed upward and speakers 3 provided on both sides in the rear of the keyboard device 2. An upper surface area of the instrument case 1 on its rear side (upper side in FIG. 1) is provided with a switch button 4*a* and a music rest section 4*b*.

Figure 2:
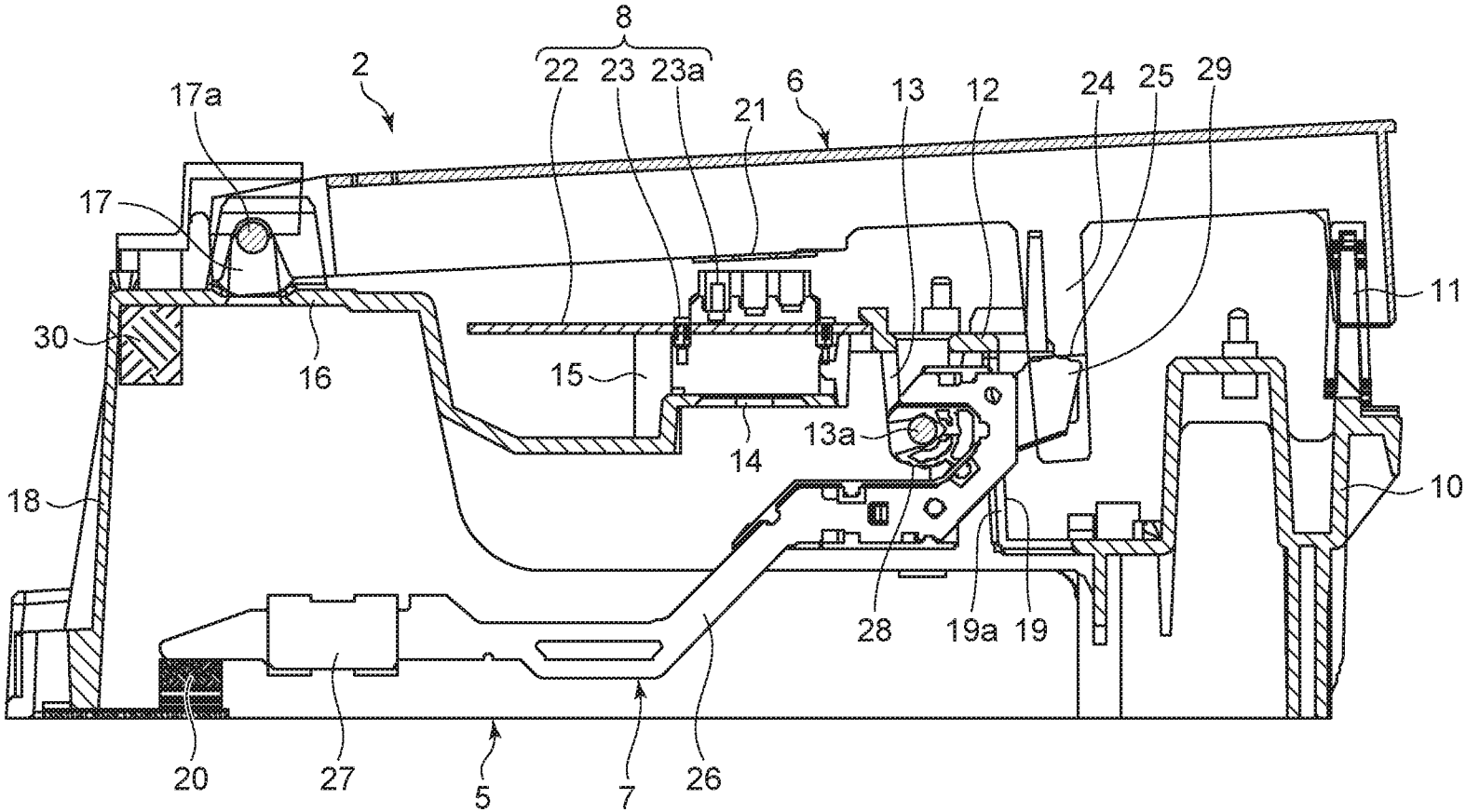
FIG. 2 is an enlarged cross-sectional view of a keyboard device of the keyboard instrument taken along line A-A in FIG. 1.
Figure 3:
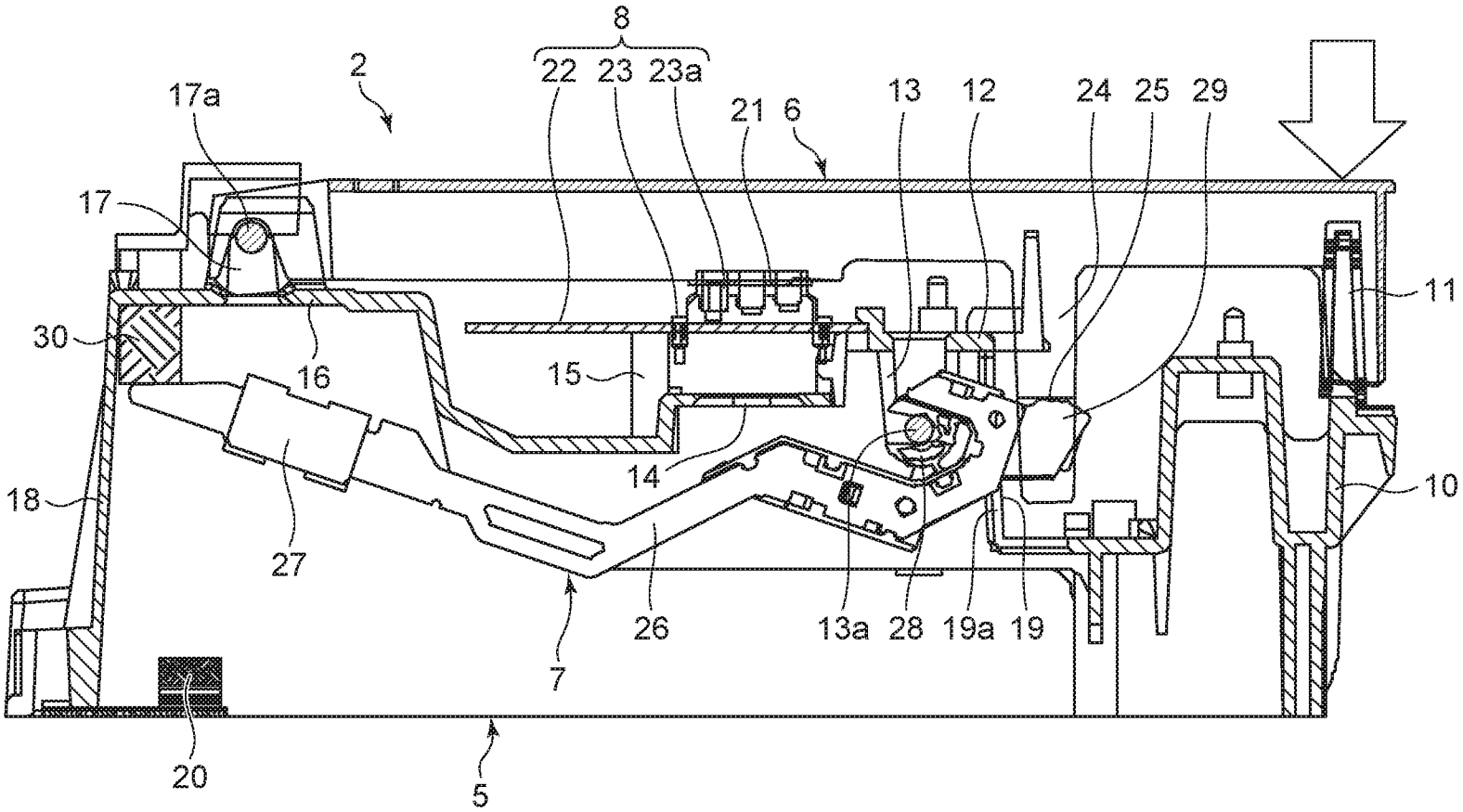
FIG. 3 is an enlarged cross-sectional view showing a state where a key of the keyboard device shown in FIG. 2 has been depressed.

The keyboard device 2 includes a synthetic-resin-made keyboard chassis 5, a plurality of keys 6 arranged on this keyboard chassis 5 and attached to be vertically rotatable, a plurality of hammer members 7 which apply action loads to keys 6 in response to depression operations on the plurality of keys 6, and a switch section 8 which outputs ON signals in response to depression operations on the plurality of keys 6, as shown in FIG. 2 and FIG. 3.

The keyboard chassis 5 is arranged inside the instrument case 1 shown in FIG. 1. On the front end (right end in FIG. 3) of this keyboard chassis 5, a front leg section 10 is provided protruding upward from the bottom. On this front leg section 10, key guide sections 11 for preventing the horizontal movements of the keys 6 are provided corresponding to the respective keys 6.

In an area posterior to the front leg section 10 (an area located to its left in FIG. 2) in this keyboard chassis 5, a hammer mounting section 12 is provided to be slightly higher than the front leg section 10, as shown in FIG. 2 and FIG. 3. On the undersurface of this hammer mounting section 12, hammer supporting sections 13 for supporting the hammer members 7 are provided projecting downward. Each hammer supporting section 13 is provided with a hammer supporting shaft 13*a* which supports a hammer member 7 such that it is vertically rotatable.

In a substantially middle area in the keyboard chassis 5 in the front-rear direction (left-right direction in FIG. 2), that is, in an area posterior and inferior to the hammer mounting section 12, a board mounting section 14 is provided to be one step lower than the hammer mounting section 12, as shown in FIG. 2 and FIG. 3. Above this board mounting section 14, the switch section 8 is attached across the hammer mounting section 12 and a board supporting section 15. In this embodiment, the board supporting section 15 is provided upright on the upper rear surface (upper left surface in FIG. 2) of the board mounting section 14.

Also, in the rear of the keyboard chassis 5, that is, on the rear side of the board mounting section 14, a key mounting section 16 is provided at a height substantially equal to the upper parts of the key guide sections 11, as shown in FIG. 2 and FIG. 3. On the upper surface of this key mounting section 16, key supporting sections 17 are provided projecting upward. Each key supporting section 17 is provided with a key supporting shaft 17*a* which supports the rear end of a key 6 such that it is vertically rotatable.

Also, on the rear end of the key mounting section 16 of the keyboard chassis 5, a rear leg section 18 which supports the rear end of the keyboard chassis 5 is downwardly provided from the upper part of the keyboard chassis 5 toward the bottom part, as shown in FIG. 2 and FIG. 3. In an area near the lower end of the rear leg section 18, a lower-limit stopper section 20 for setting a lower-limit position of the hammer member 7 is provided.

The keys 6 have white keys 6*a* and black keys 6*b*, as shown in FIG. 1. Note that, in the present embodiment, only one white key 6*a* is described. The rear end (left end in FIG. 2) of this key 6 serving as a white key 6*a* is supported by the key supporting section 17 provided on the key mounting section 16 of the keyboard chassis 5 such that it is vertically rotatable by the key supporting shaft 17*a*, as shown in FIG. 2 and FIG. 3.

On a substantially middle portion of the key 6 in the front-rear direction (left-right direction in FIG. 2), a switch pressing section 21 for pressing the switch section 8 attached onto the board mounting section 14 of the keyboard chassis 5 is provided projecting downward, as shown in FIG. 2 and FIG. 3. In this embodiment, the switch section 8 includes a switch board 22 arranged along the array direction of the keys 6 and a rubber sheet 23 arranged on this switch board 22.

In this embodiment, the switch board 22 is attached along the array direction of the keys 6 and positioned above the board mounting section 14 with its front end (right end in FIG. 2) being arranged on the hammer mounting section 12 and the other end (left end in FIG. 2) being arranged on the substrate supporting section 15 provided on the board mounting section 14, as shown in FIG. 2 and FIG. 3. The rubber sheet 23 has dome-shaped bulging sections 23*a* provided corresponding to the switch pressing sections 21 of the plurality of keys 6.

Also, as shown in FIG. 2 and FIG. 3, this switch section 8 is structured such that, when a bulging section 23*a* of the rubber sheet 23 is pressed by the corresponding switch pressing section 21, this bulging section 23*a* is elastically deformed and its movable contact point comes in contact with a fixed contact point of the switch board 22 (these contact points are not shown) to output an ON signal.

On a portion of each key 6 located in front of the switch pressing section 21 (located to the right thereof in FIG. 2) of each key 6, a hammer pressing section 24 is provided projecting downward, as shown in FIG. 2 and FIG. 3. On the lower part of this hammer pressing section 24, a hammer holding section 25 is provided which slidably holds a key contacting and sliding section 29 of the hammer member 7 described later.

As shown in FIG. 2 and FIG. 3, each hammer member 7 includes a hammer main body 26, a weight section 27 provided in a rear portion (left side portion in FIG. 2) of this hammer main body 26, a synthetic-resin-made rotation attaching section 28 provided on the front side (right side in FIG. 2) of the hammer main body 26 and serving as the rotational center of the hammer main body 26, and the key contacting and sliding section 29 provided on the front end (right end in FIG. 2) of the hammer main body 26.

This hammer member 7 is structured such that the rotation attaching section 28 of the hammer main body 26 is rotatably attached to the hammer support shaft 13*a* of the hammer supporting section 13 on the undersurface of the hammer mounting section 12 with the key contacting and sliding section 29 of the hammer main body 26 being inserted into an opening 19*a* provided in a front lowered section 19 of the hammer mounting section 12 of the keyboard chassis 5, whereby the hammer main body 26 can be vertically rotated around the hammer supporting shaft 13*a* of the hammer supporting section 13, as shown in FIG. 2 and FIG. 3.

Also, this hammer member 7 is structured such that, when the rotation attaching section 28 of the hammer main body 26 is rotatably attached to the hammer support shaft 13*a* of the hammer supporting section 13, the key contacting and sliding section 29 provided on the front end (right end in FIG. 2) of the hammer main body 26 is slidably inserted into the hammer holding section 25 formed on the hammer pressing section 24 of the key 6, as shown in FIG. 2 and FIG. 3.

As a result, this hammer member 7 is structured such that, in its normal state, the hammer main body 26 is rotated around the hammer supporting shaft 13*a* of the hammer supporting section 13 in the counterclockwise direction by the weight of the weight section 27, whereby the rear end (left end in FIG. 2) of the hammer main body 26 on the weight section 27 side comes in contact with the lower-limit stopper section 20 for position restriction, and the key contacting and sliding section 29 of the hammer main body 26 presses the hammer pressing section 24 of the key 6 upward so as to restrict the key 6 at an upper-limit position, as shown in FIG. 2.

Also, this hammer member 7 is structured such that, when the key 6 is depressed from above, the key contacting and sliding section 29 of the hammer main body 26 is pressed downward against the weight of the weight section 27 of the hammer main body 26 by the hammer pressing section 24 of key 6, whereby the hammer main body 26 is rotated around the hammer supporting shaft 13*a* of the hammer supporting section 13 in the clockwise direction, and the rear end of the hammer main body 26 on the weight section 27 side comes in contact with a key load applying member 30 provided on the undersurface of the key mounting section 16 so as to stop the rotation of the hammer main body 26 in the clockwise direction as shown in FIG. 3.

Figure 4:
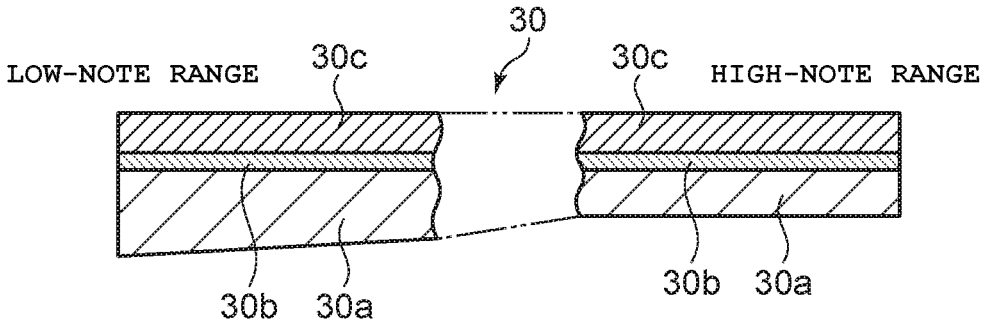
FIG. 4 is an enlarged cross-sectional view of the main portion of the keyboard device shown in FIG. 2, in which one of key load applying members arranged along the key arrangement direction is shown.

The key load applying member 30 is formed of an elastic member, and is provided on the undersurface of the key mounting section 16 of the keyboard chassis 5 so as to extend along the array direction of the keys 6. Also, this key load applying member 30 is provided such that its thickness gradually becomes thicker from the high-note range of the keys 6 toward the low-note range of the keys 6, as shown in FIG. 2 to FIG. 4. That is, this key load applying member 30 has a three layer structure where a silencing layer 30*a*, an impact-resistant layer 30*b*, and a base layer 30*c* have been laminated in this order from the surface side with which the hammer member 7 comes in contact, as shown in FIG. 4.

In this embodiment, the silencing layer 30*a* is made of an elastically-deformable elastic material such as felt, as shown in FIG. 4. This silencing layer 30*a* is elastically deformed when the key 6 is depressed to cause the hammer member 7 to come in contact with the silencing layer 30*a*, whereby the impact by the contact of the hammer member 7 is absorbed and the impact sound by the contact of the hammer member 7 is reduced.

The impact-resistant layer 30*b* is made of, for example, a low-resilient material resistant to impact force such as vibration-control rubber which suppresses vibration, as shown in FIG. 4. This impact-resistant layer 30*b* is structured such that, when the key 6 is depressed and the hammer member 7 elastically deforms the silencing layer 30*a*, the silencing layer 30*a* is pressed onto the this impact-resistant layer 30*b* by the hammer member 7 and the impact-resistant layer 30*b* receives the impact by the contact of the hammer member 7 with low resilience.

The base layer 30*c* is made of, for example, a low-resilient material slightly softer than the impact-resistant layer 30*b*, such as rubber sponge (foam rubber), as shown in FIG. 4. This base layer 30*c* is structured to elastically absorb the elastic deformation of the impact-resistant layer 30*b* when the hammer member 7 presses the silencing layer 30*a* onto the impact-resistant layer 30*b* by the depression of the key 6 and the impact-resistant layer 30*b* receives the impact with low resilience.

As shown in FIG. 4, the silencing layer 30*a* is provided such that its thickness gradually becomes thicker from the high-note range of the keys 6 toward the low-note range. The impact-resistant layer 30*b* is thin and provided to have a thickness that is uniform from the high-note range of the keys 6 to the low-note range of the keys 6. The base layer 30*c* is thicker than the impact-resistant layer 30*b* and provided to have a thickness that is uniform from the high-note range of the keys 6 to the low-note range of the keys 6.

As a result, the key load applying member 30 is structured such that, since its entire thickness gradually becomes thicker from the high-note range of the keys 6 toward the low-note range of the keys 6, a difference occurs between a deformation amount in the high-note range and a deformation amount in the low-note range when keys 6 are depressed and the corresponding hammer members 7 come in contact with the key load applying member 30, as shown in FIG. 4.

That is, the key load applying member 30 is structured such that, since the silencing layer 30*a* has a thickness that gradually becomes thicker from the high-note range toward the low-note range and the impact-resistant layer 30*b* and the base layer 30*c* each have a thickness that is uniform from the high-note range to the low-note range as shown in FIG. 4, the deformation amount of the silencing layer 30*a* is small and the key load is light when a hammer member 7 in the high-note range comes in contact with the key load applying member 30, and the deformation amount of the silencing layer 30*a* is large and the key load is heavy when a hammer member 7 in the low-note range comes in contact with the key load applying member 30.

Here, since the key load applying member 30 is provided such that its entire thickness gradually becomes thicker from the high-note range of the keys 6 toward the low-note range of the keys 6 as shown in FIG. 4, timing at which a hammer member 7 in the high-note range comes in contact with the silencing layer 30*a* comes after timing at which a hammer member 7 in the low-note range comes in contact with the silencing layer 30*a*.

Accordingly, in the structure of the key load applying member 30, when hammer members 7 are pressed into the silencing layer 30*a*, the impact-resistant layer 30*b*, and the base layer 30*c* by the corresponding keys being depressed, and these layers 30*a*, 30*b* and 30*c* are deformed, the amount of deformation by a hammer member 7 in the high-note range being pressed is smaller than the amount of deformation by a hammer member 7 in the low-note range being pressed, so that the key load in the high-note range is lighter than the key load in the low-note range, as shown in FIG. 4.

Next, the mechanism of the keyboard device 2 in this keyboard instrument will be described.

First, in an initial state where the key 6 has not been depressed, the hammer member 7 has been rotated around the hammer supporting shaft 13*a* of the hammer supporting section 13 in the counter-clockwise direction by the weight of the weight section 27 and therefore the rear end of the hammer member 7 on the weight section 27 side is in contact with the lower-limit stopper section 20 provided near the lower end of the rear leg section 18 of the keyboard chassis 5, as shown in FIG. 2.

Here, the hammer holding section 25 of the hammer pressing section 24 of the key 6 has been pressed upward by the key contacting and sliding section 29 on the tip end (right end in FIG. 2) of the hammer main body 26 as shown in FIG. 2, so that the key 6 has been rotated in the counterclockwise direction around the key supporting shaft 17*a* of the key supporting section 17 on the key mounting section 16 of the keyboard chassis 5 and restricted at its upper-limit position. Here, the switch pressing section 21 of the key 6 is above and away from the switch section 8.

In this state, when the key 6 is depressed, the key 6 is rotated around the key supporting shaft 17*a* of the key supporting section 17 in the clockwise direction and the hammer holding section 25 of the hammer pressing section 24 presses the key contacting and sliding section 29 of the hammer member 7 downward, as shown in FIG. 3. As a result, the hammer member 7 is rotated in the clockwise direction against the weight of the weight section 27, as shown in FIG. 3. Here, an action load is applied to the key 6 by the rotation of the hammer main body 26 of the hammer member 7, and therefore the key load abruptly becomes heavy.

Then, when the switch pressing section 21 of the key 6 presses the switch section 8 by the key 6 being rotated by the depression operation, the bulging section 23*a* of the rubber sheet 23 is elastically deformed. Here, the key load becomes heavier by the elastic deformation of the bulging section 23*a* of the rubber sheet 23. In this state, when the key 6 is further rotated and the switch pressing section 21 of the key 6 further presses the switch section 8, the bulging section 23*a* of the rubber sheet 23 is further elastically deformed and whereby the switch section 8 outputs a switch signal.

Then, when the key 6 is further rotated and the hammer main body 26 is further rotated, the rear end (left end in FIG. 3) of the hammer member 7 comes in contact with the key load applying member 30 provided on the undersurface of the key mounting section 13 of the keyboard chassis 5, whereby the hammer main body 26 is restricted at the upper-limit position and the rotation of the hammer member 7 is stopped. Here, the key load applying member 30 applies a key load to the key 6.

That is, when the rear end of the hammer main body 26 comes in contact with the key load applying member 30, it digs into the key load applying member 30 because of elasticity. The key load applying member 30 is elastically deformed in accordance with this entering amount of the rear end of the hammer main body 26, and applies a key load to the key 6 in accordance with the deformation amount.

In this embodiment, the key load applying member 30 has the structure where its thickness gradually becomes thicker from the high-note range of the keys 6 toward the low-note range of the keys 6. Therefore, timing at which the rear end of a hammer main body 26 in the high-note range comes in contact with the key load applying member 30 comes after timing at which the rear end of a hammer main body 26 in the low-note range comes in contact with the key load applying member 30.

Accordingly, an entering amount by which the hammer member 7 in the high-note range is internally positioned in the key load applying member 30 is smaller than an entering amount by which the hammer member 7 in the low-note range is internally positioned in the key load applying member 30. As a result of this structure, a key load to be applied to a key 6 in the high-note range is lighter than a key load to be applied to a key 6 in the low-note range.

That is, since the key load applying member 30 has the three-layer structure where the silencing layer 30*a*, the impact-resistant layer 30*b*, and the base layer 30*c* are included and the entire thickness becomes gradually thicker from the high-note range toward the low-note range, when a hammer member 7 in the high-note range comes in contact with the key load applying member 30, an entering amount by which the hammer member 7 digs into the silencing layer 30*a*, the impact-resistant layer 30*b*, and the base layer 30*c* is small, and a deformation amount by which the silencing layer 30*a*, the impact-resistant layer 30*b*, and the base layer 30*c* are deformed is also small.

When a hammer member 7 in the low-note range comes in contact with the key load applying member 30, since that portion of the key load applying member 30 is thicker than those in the high-note range, an entering amount by which the hammer member 7 digs into the silencing layer 30*a*, the impact-resistant layer 30*b*, and the base layer 30*c* is large, and a deformation amount by which the silencing layer 30*a*, the impact-resistant layer 30*b*, and the base layer 30*c* are deformed is also large.

In this embodiment, the key load applying member 30 has the structure where the silencing layer 30*a* has a thickness that gradually becomes thicker from the high-note range toward the low-note range, the impact-resistant layer 30*b* and the base layer 30*c* each have a thickness that is uniform from the high-note range to the low-note range, and the entire thickness of these layers gradually becomes thicker from the high-note range toward the low-note range, whereby the amount of deformation in the high-note range is smaller than the amount of deformation in the low-note range. As a result of this structure, key loads in the high-note range are lighter than key loads in the low-note range, which achieves a key touch feeling resembling that of the key touch feeling of an acoustic piano.

Then, when a finger on the key 6 is released therefrom and the key 6 starts a key releasing action, the hammer main body 26 of the hammer member 7 is rotated around the hammer supporting shaft 13*a* of the hammer supporting section 13 in the counterclockwise direction by the elastic return force of the key load applying member 30 and the elastic return force of the bulging section 23*a* in the rubber sheet 23 of the switch section 8, as shown in FIG. 3. Here, the key load abruptly becomes light.

Then, the hammer main body 26 is further rotated around the hammer supporting shaft 13*a* of the hammer supporting section 13 in the counterclockwise direction by the weight of the weight section 27. Accordingly, the key 6 is further rotated around the key supporting shaft 17*a* of the key supporting section 17 in the counterclockwise direction, and the rear end of the hammer main body 26 on the weight section 27 side comes in contact with the lower-limit stopper section 20 provided near the lower end of the rear leg section 18 of the keyboard chassis 5.

As a result, the hammer holding section 25 of the hammer pressing section 24 is pressed upward by the key contacting and sliding section 29 on the tip end (right end in FIG. 2) of the hammer 26 as shown in FIG. 2, whereby the key 6 is rotated around the key supporting shaft 17*a* of the key supporting section 17 in the counterclockwise direction and restricted at the upper-limit position. In this state, the key 6 is in its initial position again, and the switch pressing section 21 is above and away from the switch section 8.

As described above, the keyboard device 2 of this keyboard instrument includes the hammer members 7 each of which is rotated in conjunction with a depressed key 6 and applies an action load to the key 6, and the key load applying member 30 with which the hammer members 7 come in contact when they are rotated and apply key loads to the keys 6. With this key load applying member 30, a key load to be applied to a key 6 in the high-note range and a key load to be applied to a key 6 in the low-note range when hammer members 7 come in contact with the key load applying member 30 can be varied from each other, by which a key touch feeling resembling that of an acoustic piano can be achieved with a simple structure at low cost.

That is, in the keyboard device 2 of this keyboard instrument, a key load to be applied to a key 6 in the high-note range and a key load to be applied to a key 6 in the low-note range when the corresponding hammer members 7 are rotated in conjunction with these depressed keys 6 and come in contact with the key load applying member 30 can be made different from each other based on the contact points of the hammer members 7 with respect to the key load applying member 30. Therefore, the lengths of the keys 6 in the front-rear direction are not required to be changed for each key 6, whereby the structure of the entire device can be significantly simplified, its manufacturing cost can be reduced, and a key touch feeling resembling that of an acoustic piano can be achieved.

In this embodiment, the key load applying member 30 is made of an elastic material. Therefore, when a hammer member 7 is rotated in conjunction with a depressed key 6 and come in contact with the key load applying member 30, it can dig into the key load applying member 30 by the elasticity, and the key load applying member 30 can apply a key load to the key 6 in accordance with this entering amount.

Also, the key load applying member 30 has a thickness that gradually becomes thicker from the high-note range of the keys 6 toward the low-note range of the keys 6. As a result of this structure, timing at which a hammer member 7 in the high-note range comes in contact with the key load applying member 30 comes after timing at which a hammer member 7 in the low-note range comes in contact with the key load applying member 30. Accordingly, an entering amount by which the hammer member 7 in the high-note range digs into the key load applying member 30 is smaller than an entering amount by which the hammer member 7 in the low-note range digs into the key load applying member 30, so that a key load in the high-note range can be lighter than a key load in the low-note range.

That is, an entering amount by which a hammer member 7 in the high-note range digs into the key load applying member 30 is smaller than an entering amount by which a hammer member 7 in the low-note range digs into the key load applying member 30 when the hammer members 7 comes in contact with the key load applying member 30, whereby the deformation amount of a portion of the key load applying member 30 in the high-note range is smaller than the deformation amount of a portion of the key load applying member 30 in the low-note range. As a result of this structure, key loads in the high-note range can be lighter than key loads in the low-note range.

In this embodiment, the key load applying member 30 is formed to have the three-layer structure where the silencing layer 30*a*, the impact-resistant layer 30*b*, and the base layer 30*c* have been laminated in this order from the surface side with which the hammer members 7 come in contact. As a result of this structure, by the silencing layer 30*a*, an impact by a hammer member 7 coming in contact with the key load applying member 30 can be absorbed and an impact sound by this contact of the hammer member 7 can be reduced. In addition, the impact by the contact of the hammer member 7 can be received with low resilience by the impact-resistant layer 30*b*, and the elastic deformation of the impact-resistant layer 30*b* can be absorbed by the base layer 30*c*.

That is, the silencing layer 30*a* is made of an elastically-deformable elastic material such as felt. Therefore, when a hammer member 7 comes in contact with the key load applying member 30, the silencing layer 30*a* is elastically deformed, whereby the impact by the contact of the hammer member 7 can be absorbed and the impact sound by the contact of the hammer member 7 can be reduced.

Also, the impact-resistant layer 30*b* is made of a low-resilient material resistant to impact force, such as vibration-control rubber which suppresses vibration or the like. Therefore, when a hammer member 7 comes in contact with the key load applying member 30 and the silencing layer 30*a* is elastically deformed, the silencing layer 30*a* is pressed onto the impact-resistant layer 30*b*, whereby the impact by the contact of the hammer member 7 can be favorably received with low resilience.

Furthermore, the base layer 30*c* is made of a low-resilient material slightly softer than the impact-resistant layer 30*b*, such as rubber sponge (foam rubber). Therefore, the elastic deformation of the impact-resistant layer 30*b* can be elastically absorbed when a hammer member 7 comes in contact with the key load applying member 30 so as to press the silencing layer 30*a* onto the impact-resistant layer 30*b*, and the impact-resistant layer 30*b* receives the impact with low resilience.

Characteristics regarding the elastic deformation of the respective members of the silencing layer 30*a*, the impact-resistant layer 30*b*, and the base layer 30*c* are represented not only by elasticity (modulus of elasticity) but also by viscosity (coefficient of viscosity). The above-described low-resilient materials are materials with larger viscosity. These members more or less have the characteristics of both elasticity and viscosity (that is, have viscoelasticity). However, a member having only the characteristics of elasticity or the characteristics of viscosity may be used.

The silencing layer 30*a*, the impact-resistant layer 30*b*, and the base layer 30*c* are different from one another in at least one of thickness, level of elasticity (modulus of elasticity), and level of viscosity (coefficient of viscosity).

Here, the modulus of elasticity is a ratio between distortion and force when a force is applied to an elastic body, and is represented by, for example, the following equation.

Modulus of elasticity=Force/Distortion (Distortion=Deformed length/Original length)

Also, the coefficient of viscosity is a ratio between the rate of distortion and force when a force is applied to an elastic body, and is represented by, for example, the following equation.

Coefficient of viscosity=Force/Rate of deformation (Rate of deformation=Amount of deformation/Time)

In this embodiment, the key load applying member 30 has the structure where the silencing layer 30*a* has a thickness that gradually becomes thicker from the high-note range toward the low-note range, and the impact-resistant layer 30*b* and the base layer 30*c* each have a thickness that is uniform from the high-note range to the low-note range, so that the entire thickness of them gradually becomes thicker from the high-note range toward the low-note range. As a result of this structure, deformation amounts in the high-note range can be made smaller than deformation amounts in the low-note range, whereby key loads in the high-note range can be made lighter than key loads in the low-note range. Accordingly, a key touch feeling resembling that of an acoustic piano can be achieved.

First Modification Example

Next, a key load applying member 35 in a first modification example of this keyboard device 2 is described with reference to FIG. 5. Further, sections that are the same as those of the embodiment shown in FIG. 1 to FIG. 4 are provided with the same reference numerals.

Figure 5:
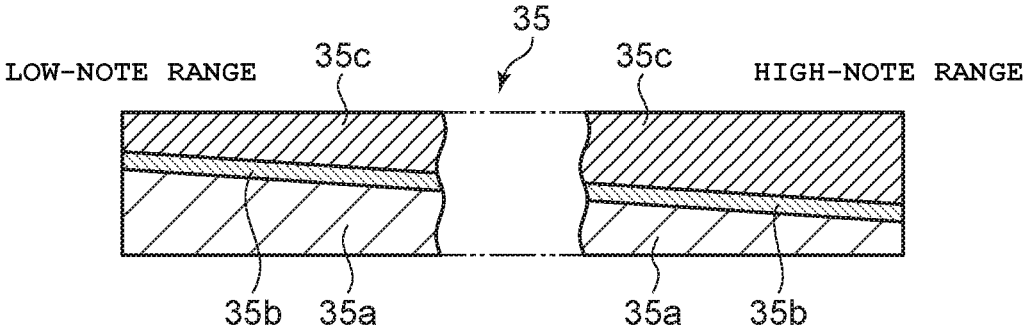
FIG. 5 is an enlarged cross-sectional view of the main portion, in which a first modification example of the key load applying member shown in FIG. 4 is shown.

This key load applying member 35 is structured such that its entire thickness is uniform from the high-note range to the low-note range and the amount of deformation when the hammer member 7 comes in contact with the key load applying member 35 is gradually increased from the high-note range toward the low-note range, as shown in FIG. 5.

That is, as with the above-described embodiment, this key load applying member 35 has a three-layer structure where a silencing layer 35*a*, an impact-resistant layer 35*b*, and the base layer 35*c* have been laminated in this order from the surface side with which the hammer members 7 come in contact, as shown in FIG. 5. In this case, the silencing layer 35*a* is made of an elastically-deformable elastic material such as felt. This silencing layer 35*a* is elastically deformed when a key 6 is depressed and the corresponding hammer member 7 comes in contact with the key load applying member 35, whereby the impact by the contact of the hammer member 7 is absorbed and the impact sound by the contact of the hammer member 7 is reduced.

As with the above-described embodiment, the impact-resistant layer 35*b* is made of a low-resilient material resistant to impact force, such as vibration-control rubber which suppresses vibration or the like, as shown in FIG. 5. This impact-resistant layer 35*b* is structured such that, when a key 6 is depressed and the corresponding hammer member 7 elastically deform the silencing layer 35*a*, the silencing layer 35*a* is pressed onto the impact-resistant layer 35*b*, and the impact-resistant layer 35*b* receives the impact by the contact of the hammer member 7 with low resilience.

As with the above-described embodiment, the base layer 35*c* is made of a low-resilient material slightly softer than the impact-resistant layer 35*b*, such as rubber sponge (foam rubber), as shown in FIG. 5. Therefore, when a hammer member 7 presses the silencing layer 35*a* onto the impact-resistant layer 35*b* by the depression of the corresponding key 6 and the impact-resistant layer 35*b* receives the impact, the elastic deformation of the impact-resistant layer 35*b* is elastically absorbed.

In this case, the silencing layer 35*a* has a thickness that gradually becomes thicker from the high-note range of the keys 6 toward the low-note range of the keys 6, as shown in FIG. 5. The impact-resistant layer 35*b* is thin and has a thickness that is uniform from the high-note range of the keys 6 to the low-note range of the keys 6. The base layer 35*c* is thicker than the impact-resistant layer 35*b*, and has a thickness that becomes thinner from the high-note range of the keys 6 toward the low-note range of the keys 6.

As a result, the entire thickness of the key load applying member 35 is uniform from the high-note range of the keys 6 to the low-note range of the keys 6, as shown in FIG. 5. Therefore, a hammer member 7 in the high-note range and a hammer member 7 in the low-note range come in contact at the same timing when the corresponding keys 6 are depressed and the hammer members 7 come in contact with the key load applying member 30. However, there is a difference in the amount of deformation between the high-note range and the low-note range.

That is, the key load applying member 35 has a thickness that is uniform from the high-note range to the low-note range, but the silencing layer 30*a*, the impact-resistant layer 30*b*, and the base layer 30*c* have different characteristics in their elasticity levels (moduli of elasticity) and/or viscosity levels (coefficients of viscosity) (either one dominantly functions) and have different thicknesses. Accordingly, the key load applying member 35 as a whole is structured such that there is a difference in at least one of the level of elasticity (modulus of elasticity) and the level of viscosity (coefficient of viscosity) between the high-note range and the low-note range.

That is, this key load applying member 35 is structured such that the silencing layer 35*a* has a thickness that gradually becomes thicker from the high-note range toward the low-note range, the impact-resistant layer 35*b* has a thickness that is uniform from the high-note range to the low-note range, and the base layer 35*c* has a thickness that gradually becomes thinner from the high-note range of the keys 6 toward the low-note range of the keys 6, as shown in FIG. 5. Therefore, when a hammer member 7 in the high-note range comes in contact with the key load applying member 35, the deformation amount of the silencing layer 35*a* is small, and the key load is light. In addition, when a hammer member 7 in the low-note range comes in contact with the key load applying member 35, the deformation amount of the silencing layer 35*a* is large, and the key load is heavy.

That is, this key load applying member 35 is structured such that, when keys 6 are depressed and the corresponding hammer members 7 are pressed into the silencing layer 35*a*, the impact-resistant layer 35*b*, and the base layer 35*c* so as to deform the silencing layer 35*a*, the impact-resistant layer 35*b*, and the base layer 35*c*, the amount of the deformation of the key load applying member 35 by a hammer member 7 in the high-note range being pressed thereinto is smaller than the amount of the deformation of the key load applying member 35 by a the hammer member 7 in the low-note range being pressed thereinto, whereby a key load in the high-note range is lighter than a key load in the low-note range, as shown in FIG. 5.

In this keyboard device 2, the thickness of the key load applying member 35 is uniform from the high-note range of the keys 6 to the low-note range of the keys 6, and the amount of elastic deformation when hammer members 7 come contact with the key load applying member 35 is gradually increased from the high-note range of the keys 6 toward the low-note range of the key 6. As a result of this structure, key loads to be applied to keys 6 when hammer members 7 come in contact with the key load applying member 35 can be made different between the high-note range of the keys 6 and the low-note range of the keys 6. Thus, as with the above-described embodiment, a simple structure, low cost, and a key touch feeling resembling that of an acoustic piano can be achieved.

That is, in this keyboard device 2, a hammer member 7 in the high-note range and a hammer member in the low-note range can come in contact at the same timing when they are rotated in conjunction with depressed keys 6 and come in contact with the key load applying member 35, and key loads to be applied to the keys 6 can be made different between the high-note range and the low-note range based on the contact points of the hammer members 7 with respect to the key load applying member 35, whereby the entire structure can be significantly simplified, the manufacturing cost can be reduced, and a key touch feeling resembling that of an acoustic piano can be achieved, as with the above-described embodiment.

In this case, the key load applying member 35 is structured such that the silencing layer 35*a* has a thickness that gradually becomes thicker from the high-note range toward the low-note range, the impact-resistant layer 35*b* has a thickness that is uniform from the high-note range to the low-note range, and the base layer 30*c* has a thickness that gradually becomes thinner from the high-note range of the keys 6 toward the low-note range of the keys 6. As a result of this structure, deformation amounts in the high-note range can be made smaller than deformation amounts in the low-note range, and whereby key loads in the high-note range can be made lighter than key loads in the low-note range, so that a key touch feeling resembling that of an acoustic piano can be achieved.

That is, this key load applying member 35 is structured such that, when keys 6 are depressed and the corresponding hammer member 7 are pressed into the silencing layer 35*a*, the impact-resistant layer 35*b*, and the base layer 35*c* so as to deform the silencing layer 35*a*, the impact-resistant layer 35*b*, and the base layer 35*c*, the amount of the deformation of the key load applying member 35 by a hammer member 7 in the high-note range being pressed thereinto is smaller than the amount of the deformation of the key load applying member 35 by a hammer member 7 in the low-note range being pressed thereinto, whereby a key load in the high-note range can be made lighter than a key load in the low-note range.

Second Modification Example

Next, a key load applying member 40 in a second modification example of this keyboard device 2 is described with reference to FIG. 6A and FIG. 6B. In this case as well, sections that are the same as those of the embodiment shown in FIG. 1 to FIG. 4 are provided with the same reference numerals.

Figure 6A:
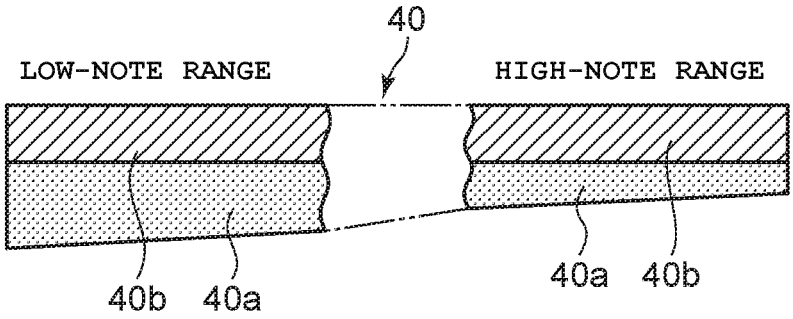
FIG. 6A is an enlarged cross-sectional view of the main portion, in which a second modification example of the key load applying member shown in FIG. 4 is shown.
Figure 6B:
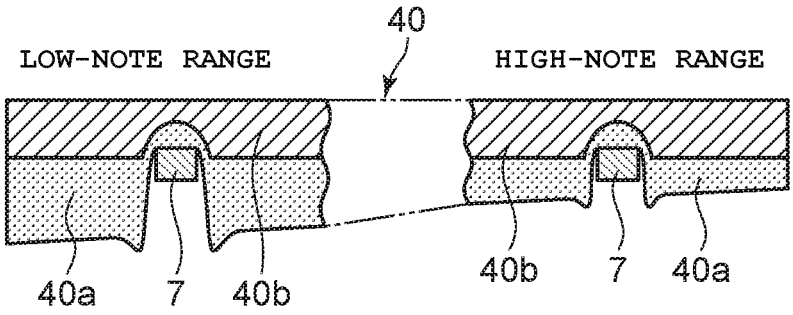
FIG. 6B is an enlarged cross-sectional view of the main portion, in which the second modification example of the key load applying member in FIG. 4 is shown with a hammer member being in contact with the key load applying member while being pressed thereinto.

This key load applying member 40 uses a gel or viscous fluid, as shown in FIG. 6A and FIG. 6B.

That is, this key load applying member 40 has a two-layer structure including a fluidized layer 40*a* having a vacuum-packed gel or viscous fluid and a base layer, as shown in FIG. 6A and FIG. 6B. In this case, when a key 6 is depressed and the fluidized layer 40*a* comes in contact with the corresponding hammer member 7, the gel or the fluid at the contact portion fluidizes to deform the fluidized layer 40*a*, whereby the impact by the contact of the hammer member 7 is absorbed and the impact sound by the contact of the hammer member 7 is reduced.

As with the base layer 30*c* of the above-described embodiment, this base layer 40*b* is made of a slightly-soft, low-resilience material such as rubber sponge (foam rubber), as shown in FIG. 6A and FIG. 6B. This base layer 40*b* is structured such that, when a key 6 is depressed and the corresponding hammer member 7 comes in contact with and deforms the fluidized layer 40*a*, the fluidized layer 40*a* is pressed onto the base layer 40*b* and elastically deforms the base layer 40*b*, whereby the impact by the contact of the hammer member 7 is elastically absorbed.

The above-described fluidized layer 40*a* is structured such that its thickness gradually becomes thicker from the high-note range of the keys 6 toward the low-note range of the keys 6 as shown in FIG. 6A and FIG. 6B, and the above-described base layer 40*b* is provided such that its thickness is uniform from the high-note range of the keys 6 to the low-note range of the keys 6.

As a result, the key load applying member 40 is provided such that its entire thickness gradually becomes thicker from the high-note range of the keys 6 toward the low-note range of the keys 6, as shown in FIG. 6A and FIG. 6B. Thus, there is a difference in the deformation amount of this key load applying member 40 between the high-note range and the low-note range when keys 6 are depressed and the corresponding hammer members 7 come in contact with the key load applying member 40.

That is, since the key load applying member 40 has the structure where the fluidized layer 40*a* has a thickness that gradually becomes thicker from the high-note range toward the low-note range and the base layer 40*b* has a thickness that is uniform from the high-note range to the low-note range as shown in FIG. 6A and FIG. 6B, the deformation amount of the fluidized layer 40*a* is small and a key load to be applied is light when a hammer member 7 in the high-note range comes in contact with the key load applying member 40, and the deformation amount of the fluidized layer 40*a* is large and a key load to be applied is heavy when a hammer member 7 in the low-note range comes in contact with the key load applying member 40.

In this case, since the key load applying member 40 is provided such that its entire thickness gradually becomes thicker from the high-note range of the keys 6 toward the low-note range of the keys 6 as shown in FIG. 6A and FIG. 6B, timing at which a hammer member 7 in the high-note range comes contact with the fluidized layer 40*a* comes after timing at which a hammer member 7 in the low-note range comes in contact with the fluidized layer 40*a*.

As a result, the key load applying member 40 is structured such that, when keys 6 are depressed and the corresponding hammer members 7 are pressed into the fluidized layer 40*a* and the base layer 40*b* to deform the fluidized layer 40*a* and base layer 40*b*, the amount of the deformation of the key load applying member 40 by a hammer member 7 in the high-note range being pressed thereinto is smaller than the amount of the deformation of the key load applying member 40 by a hammer member 7 in the low-note range being pressed thereinto, whereby a key load in the high-note range is lighter than a key load in the low-note range.

In this keyboard device 2, since the key load applying member 40 is provided to be gradually thicker from the high-note range of the keys 6 toward the low-note range of the keys 6, key loads to be applied to keys 6 when hammer members 7 come in contact with the key load applying member 40 can be made different between the high-note range of the keys 6 and the low-note range of the keys 6. Accordingly, a simple structure, low cost, and a key touch feeling resembling that of an acoustic piano can be achieved, as with the above-described embodiment.

That is, in the keyboard device 2 of this keyboard instrument, when hammer members 7 are rotated in conjunction with depressed keys 6 so as to come in contact with the key load applying member 40, timing at which a hammer member 7 in the high-note range comes in contact with the key load applying member 40 comes after timing at which a hammer member 7 in the low-note range comes in contact with the key load applying member 40, so that the entering amount of the hammer member 7 in the high-note range with respect to the key load applying member 40 is smaller than the entering amount of the hammer member 7 in the low-note range. As a result of this structure, key loads in the high-note range can be made lighter than key loads in the low-note range.

In this case, the key load applying member 40 has the two-layer structure where the fluidized layer 40*a* and the base layer 40*b* have been laminated in this order from the surface side with which the hammer members 7 come in contact. Therefore, when a hammer member 7 comes in contact with the key load applying member 40, the impact by the contact of the hammer member 7 can be absorbed by the fluidized layer 40*a* and the elasticity of the base layer 40*b*, and the impact sound by the contact of the hammer member 7 can be reduced by the fluidized layer 40*a*

That is, since the fluidized layer 40*a* is made by vacuum-packing a gel or viscous fluid, when a hammer member 7 comes in contact with the fluidized layer 40*a*, the gel or fluid at the contact portion fluidizes to deform the fluidized layer 40*a*, whereby the impact by the contact of the hammer member 7 can be absorbed and the impact sound by the contact of the hammer member 7 can be reduced.

Also, since the base layer 40*b* is made of a slightly-softer low-resilient material such as rubber sponge (foam rubber), when a hammer member 7 comes in contact with the key load applying member 40 and the fluidized layer 40*a* is deformed and pressed onto the base layer 40*b*, the base layer 40*b* is elastically deformed, whereby the impact by the contact of the hammer member 7 can be elastically absorbed.

As described above, this key load applying member 40 is structured such that the fluidized layer 40*a* has a thickness that gradually becomes thicker from the high-note range toward the low-note range, the base layer 40*b* has a thickness that is uniform from the high-note range to the low-note range, and the entire thickness of the key load applying member 40 gradually becomes thicker from the high-note range toward the low-note range, whereby deformation amounts in the high-note range can be made smaller than deformation amounts in the low-note range and key loads in the high-note range can be made lighter than key loads in the low-note range. As a result of this structure, a key touch feeling resembling that of an acoustic piano can be achieved.

That is, in this key load applying member 40, when keys 6 are depressed and the corresponding hammer members 7 are pressed into the fluidized layer 40*a* and the base layer 40*b* to deform them, the deformation amount of the key load applying member 40 by a hammer member 7 in the high-note range being pressed thereinto is smaller than the deformation amount of the key load applying member 40 by a hammer member 7 in the low-note range being pressed thereinto, whereby a key load in the high-note range can be made lighter than a key load in the low-note range.

Third Modification Example

Next, a key load applying member 41 in a third modification example of this keyboard device 2 is described with reference to FIG. 7. Further, sections that are the same as those of the second modification example shown in FIG. 6A and FIG. 6B are provided with the same reference numerals.

This key load applying member 41 is the same as that of the second modification example except that guide sections 41*a* are provided on the undersurface of the fluidized layer 40*a* with which the hammer members 7 come in contact.

Figure 7:
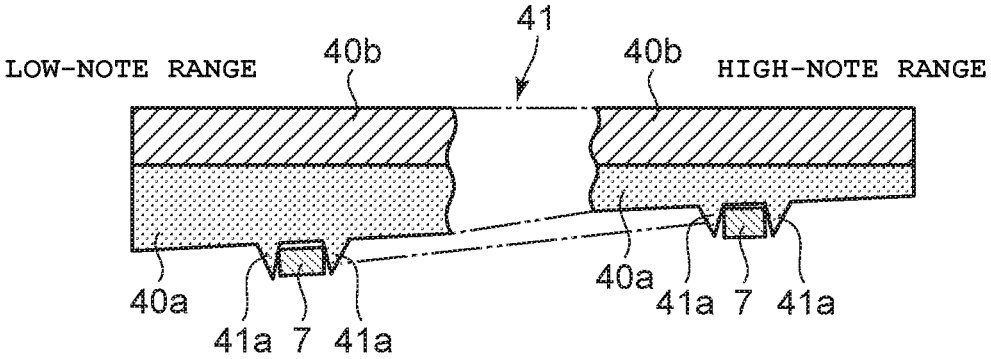
FIG. 7 is an enlarged cross-sectional view of the main portion, in which a third modification example of the key load applying member in FIG. 6 is shown.

More specifically, the guide sections 41*a* are provided on portions of the undersurface of the fluidized layer 40*a* corresponding to both side portions of each hammer member 7 and project downward, as shown in FIG. 7. As a result, when hammer members 7 come in contact with the undersurface of the fluidized layer 40*a*, the guide sections 41*a* guide both side portions of each of the hammer members 7 so as to prevent their horizontal movements and bring them into contact with predetermined portions of the undersurface of the fluidized layer 40*a*.

With this keyboard device 2, advantageous effects similar to those of the second modification example can be achieved. In addition, when hammer members 7 come in contact with the undersurface of the fluidized layer 40*a*, the guide sections 41*a* provided on the undersurface of the fluidized layer 40*a* that is in contact with which the hammer members 7 guide the hammer members 7 to prevent their horizontal movement, whereby the amount of deformation by a hammer member 7 in the high-note range being pressed thereinto can be made smaller than the amount of deformation by a hammer member 7 in the low-note range being pressed thereinto with high accuracy, and a key load in the high-note range can be accurately and favorably made lighter than a key load in the low-note range.

Fourth Modification Example

Next, a key load applying member 42 in a fourth modification example of this keyboard device 2 is described with reference to FIG. 8. Further, sections that are the same as those of the third modification example shown in FIG. 7 are provided with the same reference numerals.

Figure 8:
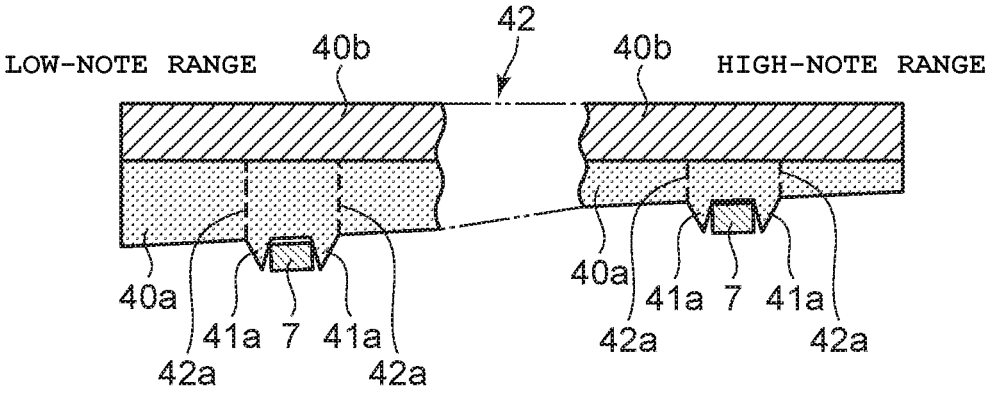
FIG. 8 is an enlarged cross-sectional view of the main portion, in which a fourth modification example of the key load applying member in FIG. 7 is shown.

This key load applying member 42 is the same as that of the third modification example except that partition sections 42*a* are provided in the fluidized layer 40*a* with which the hammer members 7 come in contact, as shown in FIG. 8.

That is, the partition sections 42*a* are provided in the fluidized layer 40*a* with which the hammer members 7 come in contact with, and correspond to both sides of each hammer member 7, that is, both side portions of each guide section 41*a* provided on the undersurface of the fluidized layer 40*a*, as shown in FIG. 8. As a result, the inside of the fluidized layer 40*a* is partitioned by the partition sections 42*a* for each hammer member 7.

As a result, the key load applying member 42 is structured such that, when a hammer member 7 comes in contact with the fluidized layer 40*a*, the gel or fluid of that portion of the fluidized layer 40*a* does not flow to an area corresponding to an adjacent hammer member 7. It flows within its own area acquired by partition by the partition sections 42*a*, whereby the fluidized layer 40*a* is deformed and pressed into the base layer 40*b* to elastically deform the base layer 40*b*.

With this key load applying member 42, advantageous effects similar to those of the third modification example can be achieved. In addition, since the partition sections 42*a* corresponding to both sides of each hammer member 7 are provided in the fluidized layer 40*a* with which the hammer members 7 come in contact, when a hammer member 7 comes in contact with the fluidized layer 40*a*, the gel or fluid of that portion of the fluidized layer 40*a* does not flow to an area corresponding to an adjacent hammer member 7, and flows within its own area acquired by partition by the partition sections 42*a* so as to deform the fluidized layer 40.

As described above, in this key load applying member 42, the gel or fluid of each portion flows within its own area acquired by partition by the partitioning section 42*a*, so that the fluidized layer 40*a* can be reliably deformed to be pressed onto the base layer 40*b*, and the base layer 40*b* can be favorably elastically deformed. Accordingly, the amount of the deformation of the key load applying member 42 by a hammer member 7 in the high-note range being pressed thereinto can be made smaller than the amount of the deformation of the key load applying member 42 by a hammer member 7 in the low-note range being pressed thereinto with high accuracy, and a key load in the high-note range can be accurately and favorably made lighter than a key load in the low-note range.

In the above-described second to fourth embodiments, the fluidized layer 40*a* in the key load applying member 40, 41 or 42 has a thickness that gradually becomes thicker from the high-note range toward the low-note range, the base layer 40*b* has a thickness that is uniform from the high-note range to the low-note range, and the entire thickness of the key load applying member 40, 41 or 42 gradually becomes thicker from the high-note range toward the low-note range. However, the present invention is not limited thereto. For example, as in the first modification example, the key load applying member may be provided such that its entire thickness is uniform from the high-note range to the low-note range.

In this case, the key load applying member is provided such that the fluidized layer 40*a* has a thickness that gradually becomes thicker from the high-note range toward the low-note range, the base layer 40*b* has a thickness that gradually becomes thinner from the high-note range toward the low-note range, and the entire thickness of the key load applying member is uniform from the high-note range to the low-note range, whereby the amount of deformation when hammer members 7 come in contact with the key load applying is gradually increased from the high-note range of the keys 6 toward the low-note range of the keys 6.

While one embodiment of the present invention and its modification examples have been described above, keyboard instruments and keyboard devices for achieving the above-described various effects are not necessarily required to have the above-described structures and may have, for example, the structures described below.

Structural Example 1

A keyboard device including a plurality of hammer members provided corresponding to a plurality of keys, whereby each hammer member applies an action load to a depressed key by rotating in conjunction with the key, and a key load applying member which applies a key load to the key by the hammer member coming in contact therewith when the hammer member is rotated, in which the key load applying member is singly provided corresponding to the plurality of keys, and a first portion of the key load applying member corresponding to a first key and a second portion of the key load applying member corresponding to a second key are different in at least one of thickness, level of elasticity, and level of viscosity.

Structural Example 2

The keyboard device of Structural Example 1, in which at least one of thickness, level of elasticity, and level of viscosity of the key load applying member is continuously varied along an array direction of the plurality of keys.

Structural Example 3

The keyboard device of Structural Example 2, in which the key load applying member has a thickness that gradually becomes thicker from a high-note range toward a low-note range.

Structural Example 4

The keyboard device of Structural Example 1, in which the key load applying member has a portion corresponding to keys in a high-note range and a portion corresponding to keys in a low-note range which are different in at least one of amount of deformation when the hammer member comes in contact with the key load applying member and key load to be applied to the key when the hammer member comes in contact with the key load applying member.

Structural Example 5

The keyboard device of Structural Example 4, in which a deformation amount of the key load applying member is increased from the high-note range toward the low-note range.

Structural Example 6

The keyboard device of Structural Example 1, in which the key load applying member has a plurality of members with different materials laminated in a direction in which the hammer member is deformed when coming in contact with the key load applying member.

Structural Example 7

The keyboard device of Structural Example 6, in which the key load applying member has laminated therein a plurality of members with different elasticities, and at least one of the plurality of members has a thickness continuously varied along an array direction of the plurality of keys.

Structural Example 8

The keyboard device of Structural Example 6, in which the key load applying member includes at least two of a silencing layer made of a member for silencing an impact sound occurred by contact of the hammer member, an impact-resistant layer made of a member for receiving an impact occurred by the contact of the hammer member, and a base layer made of a member for elastically absorbing a force occurred by the contact of the hammer member.

Structural Example 9

The keyboard device of Structural Example 8, in which the impact-resistant layer is a member resistant to impact, and the base layer is a member softer and thicker than the impact-resistant layer, and in which the base layer elastically absorbs elastic deformation of the impact-resistant layer when the impact-resistant layer receives the impact occurred by the contact of the hammer member.

Structural Example 10

The keyboard device of Structural Example 8, in which the key load applying member has a three-layer structure where the silencing layer, the impact-resistant layer, and the base layer have been arranged in the order of the silencing layer, the impact-resistant layer, and the base layer from a surface side with which the hammer member comes in contact.

Structural Example 11

The keyboard device of Structural Example 1, in which the key load applying member includes a gel or viscous fluid.

Structural Example 12

A keyboard instrument including the keyboard device of Structural Example 1.

While the present invention has been described with reference to the preferred embodiments, it is intended that the invention be not limited by any of the details of the description therein but includes all the embodiments which fall within the scope of the appended claims.

What is claimed is:

1. A keyboard device comprising:

a plurality of hammer members provided corresponding to a plurality of keys, whereby each hammer member applies an action load to a depressed key by rotating in conjunction with the key; and a single key load applying member which applies a key load to each of the keys by the corresponding hammer member coming in contact therewith when the hammer member is rotated, wherein a first portion of the key load applying member corresponding to a first key and a second portion of the key load applying member corresponding to a second key are different in at least one of thickness, level of elasticity, and level of viscosity.

2. The keyboard device according to claim 1, wherein at least one of thickness, level of elasticity, and level of viscosity of the key load applying member is continuously varied along an array direction of the plurality of keys.

3. The keyboard device according to claim 2, wherein the key load applying member has a thickness that gradually becomes thicker from a high-note range toward a low-note range.

4. The keyboard device according to claim 1, wherein the key load applying member has a portion corresponding to keys in a high-note range and a portion corresponding to keys in a low-note range which are different in at least one of amount of deformation when the hammer member comes in contact with the key load applying member and key load to be applied to the key when the hammer member comes in contact with the key load applying member.

5. The keyboard device according to claim 4, wherein a deformation amount of the key load applying member is increased from the high-note range toward the low-note range.

6. The keyboard device according to claim 1, wherein the key load applying member has a plurality of members with different materials laminated in a direction in which the hammer member is deformed when coming in contact with the key load applying member.

7. The keyboard device according to claim 6, wherein the key load applying member has laminated therein a plurality of members with different elasticities, and at least one of the plurality of members has a thickness continuously varied along an array direction of the plurality of keys.

8. The keyboard device according to claim 6, wherein the key load applying member includes at least two of a silencing layer made of a member for silencing an impact sound occurred by contact of the hammer member, an impact-resistant layer made of a member for receiving an impact occurred by the contact of the hammer member, and a base layer made of a member for elastically absorbing a force occurred by the contact of the hammer member.

9. The keyboard device according to claim 8, wherein the impact-resistant layer is a member resistant to impact, and the base layer is a member softer and thicker than the impact-resistant layer, and wherein the base layer elastically absorbs elastic deformation of the impact-resistant layer when the impact-resistant layer receives the impact occurred by the contact of the hammer member.

10. The keyboard device according to claim 8, wherein the key load applying member has a three-layer structure where the silencing layer, the impact-resistant layer, and the base layer have been arranged in the order of the silencing layer, the impact-resistant layer, and the base layer from a surface side with which the hammer member comes in contact.

11. The keyboard device according to claim 1, wherein the key load applying member includes a gel or viscous fluid.

12. A keyboard instrument comprising:

a keyboard having a plurality of keys arranged from a key corresponding to a low-note range to a key corresponding to a high-note range;

a plurality of hammer members provided corresponding to the plurality of keys, whereby each hammer member applies an action load to a depressed key by rotating in conjunction with the key; and a single key load applying member which applies a key load to each of the keys by the corresponding hammer member coming in contact therewith when the hammer member is rotated, wherein a first portion of the key load applying member corresponding to a first key and a second portion of the key load applying member corresponding to a second key are different in at least one of thickness, level of elasticity, and level of viscosity.

* * * * *